US005685249A

United States Patent [19]

Zeller

[11] Patent Number: 5,685,249

[45] Date of Patent: Nov. 11, 1997

[54] APPARATUS FOR THE ACCURATELY POSITIONED GUIDANCE FLAT TEXTILE STRUCTURES

[75] Inventor: Hans Zeller, Rebstein, Switzerland

[73] Assignee: Perfecta Schmid AG, Rorschach, Switzerland

[21] Appl. No.: 588,925

[22] Filed: Jan. 19, 1996

[30] Foreign Application Priority Data

Feb. 14, 1995 [CH] Switzerland ..... 00426/95

[51] Int. Cl.[6] ..... D05B 11/00

[52] U.S. Cl. ..... 112/470.14; 112/118

[58] Field of Search ..... 112/470.14, 470.18, 112/117, 118, 80.31, 163

[56] References Cited

U.S. PATENT DOCUMENTS

| | | | |
|---|---|---|---|
| Re. 24,305 | 4/1957 | Shotsky | 112/118 X |
| 2,895,438 | 7/1959 | Shotsky | 112/117 X |
| 3,385,246 | 5/1968 | Schlegel | 112/118 |
| 4,006,697 | 2/1977 | Robertson | 112/118 |
| 5,505,150 | 4/1996 | James et al. | 112/117 X |

FOREIGN PATENT DOCUMENTS 2094081 2/1972 France .

*Primary Examiner*—Paul C. Lewis
*Attorney, Agent, or Firm*—Edwin D. Schindler

[57] ABSTRACT

An apparatus for the accurate positioning and guiding of flat textile structures for undertaking stitching work on a multi-needle sewing machine is disclosed, which includes a plurality of needles and threads with two transporting devices guiding the flat textiles forward and backward in a transporting direction (y). The transporting devices are supported on a carriage which is able to be driven in an axial direction (x). The apparatus further includes a compression plate with needle passages, associated with the needles, and with a stationary supporting surface supporting the flat textile structures. The compression plate has inlet and outlet sides with a clamping sheet being arranged on each of the inlet and outlet sides, and with a clamping plate being arranged under each clamping sheet. The clamping plates are synchronously able to be moved with the carriage in the axial direction, and between which the flat textile structures are securely retained.

17 Claims, 2 Drawing Sheets

APPARATUS FOR THE ACCURATELY POSITIONED GUIDANCE FLAT TEXTILE STRUCTURES

BACKGROUND OF INVENTION

1. Technical Field of the Invention

The present invention relates, generally, to an apparatus for the accurate positioning and guiding of flat textile structures during stitching work on, preferably, a multi-needle stitching machine.

More particularly, the present invention relates to an apparatus for the accurate positioning and guidance of flat textile structures during their working on a multi-needle stitching machine having a plurality of needles and threads with two transporting means guiding the flat textiles forward and backward in a transporting direction (y). The transporting means are supported on a carriage which is drivable in an axial direction (x). The apparatus includes a compression plate with needle passages, associated with the needles, and with a stationary supporting surface supporting the flat textile structures.

The compression plate has inlet and outlet sides with a clamping sheet being arranged on each of the inlet and outlet sides, and with a clamping plate being arranged under each clamping sheet. The clamping plates are synchronously movable with the carriage in the axial direction, and between which the flat textile structures are securely retained.

2. Description of the Prior Art

In stitching work on a multi-needle stitching machine, the flat textile structure to be worked, including, for example, a top fabric and a bottom fabric, as well as a wadded insert, is guided across a stationary supporting surface, under which catchers are arranged. A pair of rolls is arranged on each of the inlet and outlet sides which keep the flat structure taut within the zone of the supporting surface and transport the flat structure across the latter. The two pairs of clamping rolls serving for the transport of the stepping material are, furthermore, supported on a common carriage with which the two pairs of rolls are axially displaceable. Due to the axial displacement of the clamping rolls and the simultaneous transport across the supporting surface, it is possible to produce substantially any type of desired stitching pattern.

In order to obtain a flawless formation of stitches and, particularly, to keep the insertion of the top thread as limited as possible, the stitching material has to be kept clamped within the piercing zone of the needles as the stitches are being formed. Furthermore, the stitching material has to be compressed with the zone of stitch formation, i.e., its thickness is compressed to a fraction. However, the means used for such compression lead to the fact that the axial displacement of the stitching material is opposed by frictional forces, which are independent of the quality of the top and bottom fabrics, as well as of the filling.

As a consequence of the foregoing, the material being stitched cannot precisely follow the movement of the pairs of clamping rolls and always slightly trails said clamping rolls. This makes the production of patterns more difficult and a factor which must continually be taken into account for each material combination, as so to be able to appropriately stitch the desired pattern. This, however, is unsatisfactory. Such after-running of the stitching material has a particularly pronounced effect if the stitching is carried out simultaneously with three rows of needles; such rows having different spacings from the pairs of transport rolls.

SUMMARY OF THE INVENTION

It is, therefore, an object of the present invention to provide an apparatus for the accurate positioning and guiding of flat textile structures during stitching work, which permits the production of stitching patterns which conform to a master pattern.

It is a further object of the present invention to provide an apparatus for the accurate positioning and guiding of flat textile structures during stitching work on a multi- needle stitching machine which overcomes the disadvantages inherent in prior art devices and procedures.

The foregoing and related objects are achieved by an apparatus for the accurate positioning and guiding of flat textile structures of the present invention, which includes a plurality of needles and threads with two transporting means guiding the flat textiles forward and backward in a transporting direction (y). The transporting means are supported on a carriage which is drivable in an axial direction (x). The apparatus includes a compression plate with needle passages, associated with the needles, and with a stationary supporting surface supporting the flat textile structures.

The compression plate has inlet and outlet sides with a clamping sheet being arranged on each of the inlet and outlet sides, and with a clamping plate being arranged under each clamping sheet. The clamping plates are synchronously movable with the carriage in the axial direction, and between which the flat textile structures are securely retained.

With the clamping means running with the carriage, it is always possible to guide the stitching material synchronously with the axial movement of the carriage and to, thus, work such material in its accurate position. Any yielding or after-running is prevented in this manner and it is possible to even produce closed figures, e.g., circles. The clamping sheets, which are arranged on the inlet and outlet sides, are uniformly pressed onto the clamping plates disposed underneath, i.e., across the entire width of the stitching machine, and retain the stitching material in the axial direction without obstructing the feed of the material across the supporting surface.

The clamping sheets and the clamping plates extend close to the needles and, in this manner, retain the stitching material on both sides of the needle. The clamping sheets, the clamping plates and the clamping strips are connected at their ends with the carriage supporting the clamping rolls. Consequently, no separate drive is required. The sliding and guiding elements between the precompression plate and the clamping sheet permit, on the one hand, low-friction reciprocal sliding and exact guidance in the axial direction, on the other hand. Spacing of the clamping sheets from the supporting surface takes place simultaneously and synchronously with the adjustment of the precompression plate.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
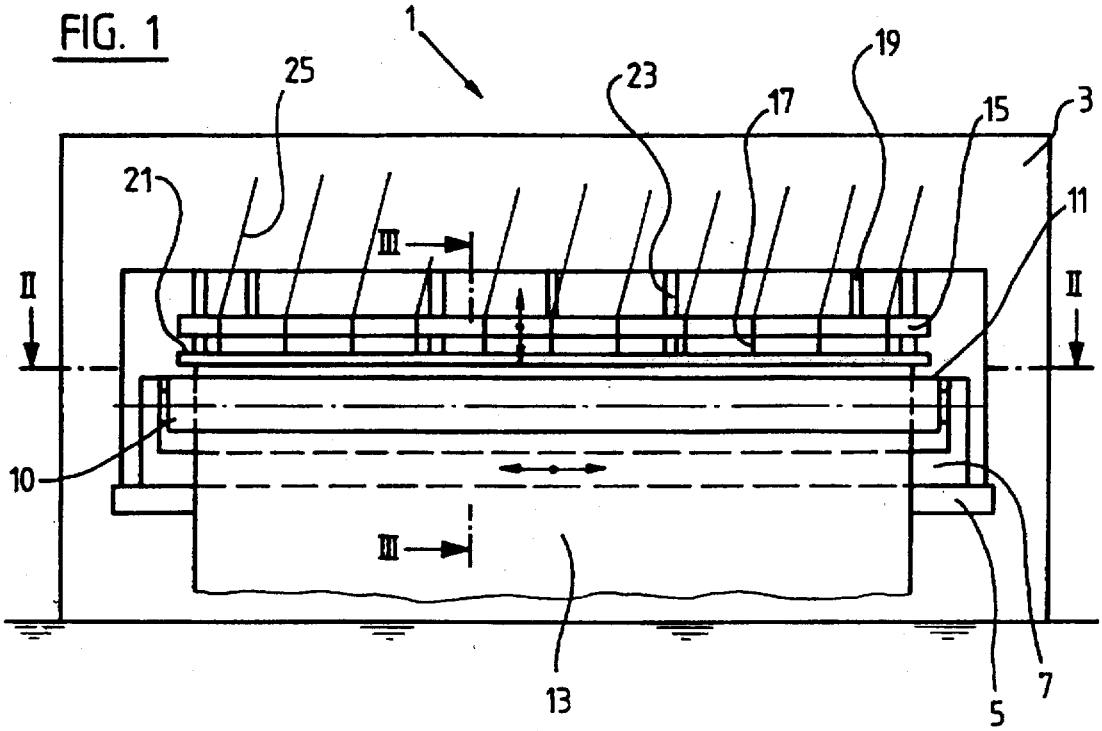
FIG. 1 shows a schematic view of a multi-needle stitching machine comprising the apparatus of the present invention.

Turning now, in detail, to an analysis of the drawing figures, a multi-needle stitching machine 1 with a portal-like housing 3 supports a carriage 7 on a horizontal guide 5. The carriage 7 is disposed within the portal and its two ends, the latter projecting beyond the stitching machine on both sides; each support a drivable pair of clamping rolls 9, 10. The drive of the pairs of clamping rolls 9, 10 is not shown for purposes of clarity. The supporting surface 11 for the stitching material 13 to be worked, is shown between the frame-like carriage 7. In most cases, the stitching material 13 comprises a plurality of flat structures, for example, a top fabric and a bottom fabric, as well as a filling wadding material. The three flat structures are combined before they enter the machine between the pairs of clamping rolls 9 on the inlet side. A needle bar 15 is visible above the supporting surface 11; said needle bar supporting a plurality of needles 17 and being drivable along the vertical guides 19 by a drive (not shown.) A precompression plate 21 is disposed underneath the needle bar 15; said plate being supported on a housing 3 at a number of points by means of holding bars 23, and vertically adjustable via a center adjustment device. The threads 25 are supplied to the needles 17 from a thread spool rack (not shown) arranged adjacent to the stitching machine 1.

Figure 2:
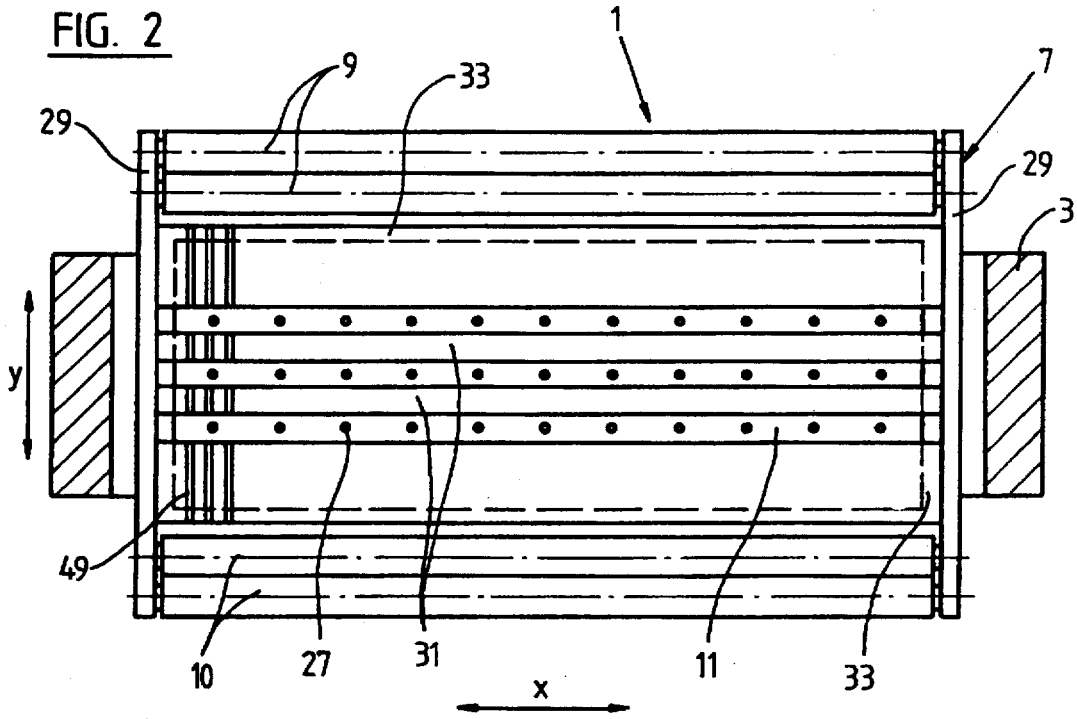
FIG. 2 shows a horizontal sectional view taken along line II—II in FIG. 1.

In the representation according to FIG. 2, stitch holes 27 are visible in the supporting surface 11; the needles 17 being guided through said holes in order to receive the bottom thread from the catchers there arranged. (The catchers are not shown, as their mode of operation is well known to the skilled artisan.) The pairs of clamping rolls 9, 10 are supported in the lateral ends 29 of the carriage 7, and the clamping strips 31; the latter extending between the rows of needles, are secured within the zone above the supporting surface 11.

The clamping strips 31 are comprised of thin strips of sheet metal, which rest upon the supporting surface 11 and are secured on the ends 29 on the face sides. The support plates 33 are arranged on the supporting surface 11 in the zones between the pairs of clamping rolls 9, 10 and the out-wardly disposed rows of stitch holes; said support plates, in turn, being secured on the face sides on the ends 29 of the carriage 7. Therefore, when the carriage 7 is axially displaced in the guide 5, the clamping strips 31 and the clamping plates 33 are slidingly moved along on the supporting surface 11. So that the friction is kept as low as possible, the bottom sides of the clamping strips 31 and of the clamping plates 33 and/or the surface of the supporting surface 11 are fitted with a sliding coating.

The clamping and inserting sheets 35 are arranged above the clamping plates 33; the edges 36 of said sheets, said edges facing the rows of needles, grip under the precompression plate 21. Preferably, within the zones of overlapping with the clamping sheets 35, the precompression plate 21 has a recess corresponding with the thickness of the clamping sheets 35, so that their bottom sides are disposed in one single plane. The sliding or guiding elements 37 are inserted between the contact surfaces of the clamping sheets 35 and the precompression plate 21; such elements permit low-friction reciprocal sliding. Coatings made of Teflon (trade-mark of DuPont) or Teflon strips, or similar plastics, can be used as the sliding elements 37. On the face sides, the two clamping sheets 35 are each secured on a support plate 39; said support plates, in turn, being vertically displaceably supported on the ends 29 of the carriage 7.

The support plates 39 are displaceable on the ends 29 of the carriage 7, along vertical guides 41, and the two springs 43 serve the purpose of keeping the support plates 39—and the clamping sheets 35 secured thereon—pressed against the precompression plate 21 from the bottom. When the precompression plate is adjusted, which may take place centrally from a point on the machine, this permits adjusting the clamping sheets 35 simultaneously to the thickness of the stitching material 13.

Figure 3:
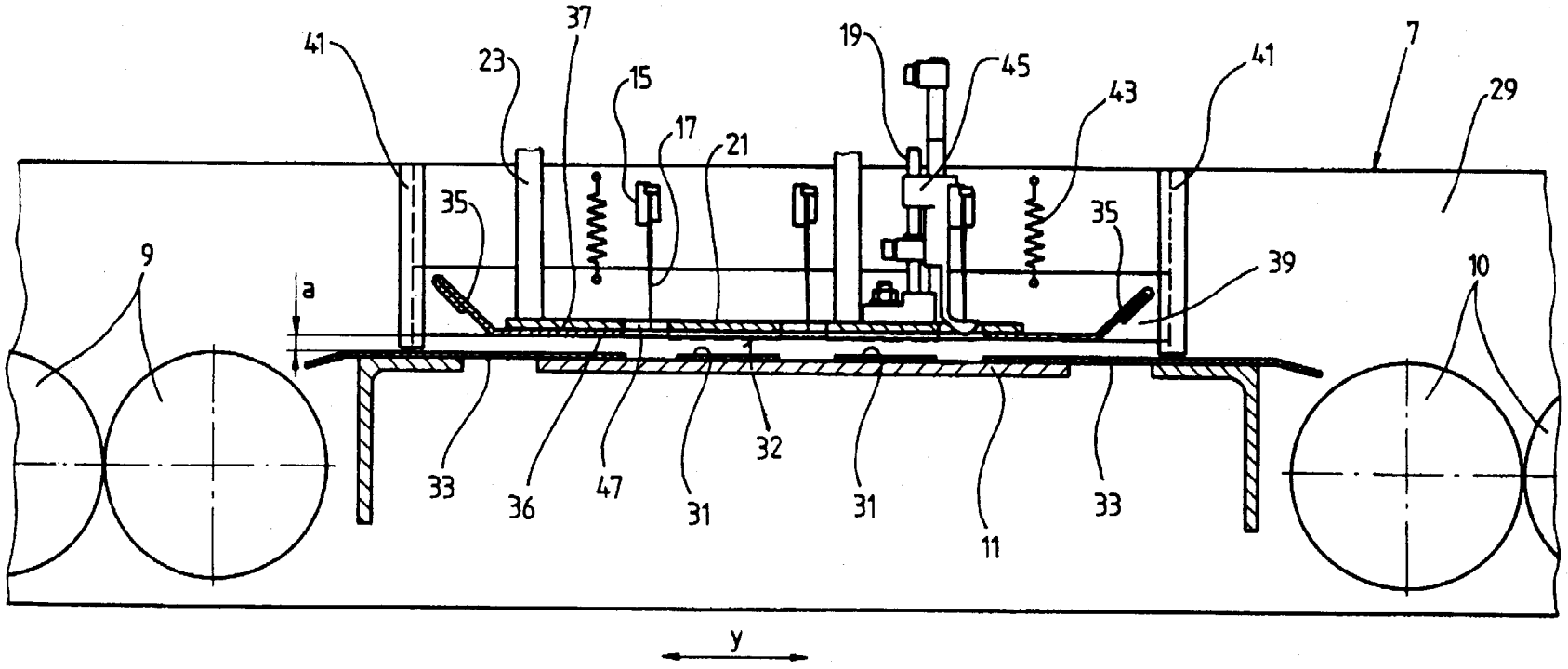
FIG. 3 shows a cross-sectional view taken along line III—III in FIG. 1, through the multi-needle stitching machine within the zone of the supporting surface.

The mode of operation of the claimed apparatus is as follows:

The stitching material 13 is kept taut between the clamping lines of the two pairs of clamping rolls 9, 10 and can be transported through between the needles 17, by corresponding rotations of the clamping rolls 9, 10 forward and backward (as shown in FIG. 3, from the left to the right and, then, from right to left.)

Prior to the start of the stitching work, the precompression plate 21 and, therefore, the clamping sheets 35 synchronously with it, is lowered onto the stitching material in accordance with the thickness of the stitching material 13 in order to obtain precompression. Following such an adjustment, the precompression plate 21 is stationary and remains in this position until it is adjusted again for another stitching material, or readjusted. As the needles 17 are being lowered by the needle bars 15, the fabric pressers 45 are simultaneously guided through the recesses 47 in the precompression plate 21, and keep the stitching material 13 elastically clamped tight on the supporting surface 11 until the needles 17, after seizing the bottom thread, exit again from the stitching material.

If the movements of the stitching material 13 take place only in the y-direction, i.e., the stitching material 13 is transported by the pairs of clamping rolls 9, 10, forward and backward, the stitches can be accurately inserted by the needles 17 in the stitching material 13 along straight lines. If a movement of the stitching material 13 takes place simultaneous 17 or only in the x-direction, during which the carriage 7, with the two pairs of clamping rolls 9, 10 is displaced axially with the axes of the clamping rolls, the clamping plates 33 and the clamping sheets 35 clamping the stitching material 13 together, as well as the clamping strips 31, guide the stitching material accurately positioned through and under the needles, and substantially permit the production of any desired stitched patterns without any distortion due to friction of the stitching material 13 on the supporting surface 11 and the precompression plate 21. The clamping plates 33 and the clamping sheets 31 are disposed so close to each other that any contact between the stitching material 13 and the supporting surface 11 can barely take place only when the stitching material 13 is forced against the latter by the fabric presser 45 as a stitch is being formed.

Tests have shown that the arrangement of the clamping strips 31, clamping plates 33 and clamping sheets 35, shown in FIG. 3, suffices in the majority of cases. Alternatively, additional clamping strips 32 can be mounted on the bottom side of the precompression plate 21 in order to cancel friction of the stitching material 13 on said stationary segment. The clamping strips 32 are shown in FIG. 3 by the broken lines; said strips being secured with their ends on the support plates 39.

In accordance with a further preferred embodiment of the present invention, provision can be made on the clamping strips 31, clamping plates 33 and/or clamping sheets 35 for the grooves or beads 49 extending in the y-direction, which additionally counteract any displacement of the stitching material 13 in the x-direction (grooves 49 being indicated in FIG. 2.)

While only several embodiments of the present invention have been shown and described, it will be obvious to those skilled in the art that many modifications may be made to the present invention without departing from the spirit and scope thereof.

What is claimed is:

1. An apparatus for an accurately positioned guidance of a flat textile structure on a multi-needle stitching machine, comprising:

a plurality of needles and threads;

two transporting means for guiding a flat textile structure forward and backward and for keeping the flat textile structure taut in a transporting direction, said plurality of needles and threads being disposed between said two transporting means;

a carriage supporting said two transporting means and being drivable in an axial direction, said axial direction being perpendicular to said transporting direction;

a precompression plate having needle passages associated with said plurality of needles, said precompression plate having an inlet side and an outlet side;

a stationary supporting surface supporting said flat textile structure;

a clamping sheet being arranged on each of the inlet side and the outlet side of said precompression plate; and, a clamping plate being arranged underneath each of said clamping sheets, said clamping plates being synchronously movable with said carriage in said axial direction, and between which the flat textile structure is non-displaceably retained in said axial direction.

2. The apparatus for an accurately positioned guidance of a flat textile structure according to claim 1, further comprising a plurality of clamping strips being arranged underneath said precompression plate on both sides of the needle passages, said clamping strips being movable with said carriage in said axial direction.

3. The apparatus for an accurately positioned guidance of a flat textile structure according to claim 2, wherein said clamping strips are supported by sliding means on said stationary supporting surface, said clamping strips being secured with their ends on said carriage.

4. The apparatus for an accurately positioned guidance of a flat textile structure according to claim 1, wherein said clamping sheets engage said precompression plate from below and are pressed by said precompression plate against said clamping plates.

5. The apparatus for an accurately positioned guidance of a flat textile structure according to claim 4, further comprising sliding and guiding elements inserted between contact surfaces of said clamping sheets and said precompression plate.

6. The apparatus for an accurately positioned guidance of a flat textile structure according to claim 1, further comprising means for adjusting a spacing of said clamping sheets and said precompression plate from said stationary supporting surface.

7. The apparatus for an accurately positioned guidance of a flat textile structure according to claim 1, further comprising vertical guides for guiding fabric pressers, said vertical guides being mounted on said precompression plate with heads of said fabric pressers being elastically lowerable through the needle passages against said stationary supporting surface as a stitch is being formed by a needle of said plurality of needles.

8. The apparatus for an accurately positioned guidance of a flat textile structure according to claim 1, wherein said clamping sheets have grooves or beads extending in said transporting direction.

9. The apparatus for an accurately positioned guidance of a flat textile structure according to claim 1, wherein said clamping plates have grooves or beads extending in said transporting direction.

10. The apparatus for an accurately positioned guidance of a flat textile structure according to claim 1, wherein said clamping strips have grooves or beads extending in said transporting direction.

11. An apparatus for an accurately positioned guidance of a flat textile structure on a multi-needle stitching machine, comprising:

a plurality of needles and threads;

two transporting means for guiding a flat textile structure forward and backward and for keeping the flat textile structure taut in a transporting direction, said plurality of needles and threads being disposed between said two transporting means;

a carriage supporting said two transporting means and being drivable in an axial direction, said axial direction being perpendicular to said transporting direction;

a precompression plate having needle passages associated with said plurality of needles, said precompression plate having an inlet side and an outlet side;

a clamping sheet being arranged on each of the inlet side and the outlet side of said precompression plate; and, a first clamping plate between said transporting means and said precompression plate, with additional clamping plates being arranged underneath each of said clamping sheets, said clamping plates being synchronously movable with said carriage in said axial direction, and between which the flat textile structure is non-displaceably retained in said axial direction.

12. The apparatus for an accurately positioned guidance of a flat textile structure according to claim 11, further comprising a plurality of clamping strips being arranged underneath said precompression plate on both sides of the needle passages, said clamping strips being movable with said carriage in said axial direction.

13. The apparatus for an accurately positioned guidance of a flat textile structure according to claim 11, wherein said clamping sheets engage said precompression plate from below and are pressed by said precompression plate against said clamping plates.

14. The apparatus for an accurately positioned guidance of a flat textile structure according to claim 13, further comprising sliding and guiding elements inserted between contact surfaces of said clamping sheets and said precompression plate.

15. The apparatus for an accurately positioned guidance of a flat textile structure according to claim 11, wherein said clamping sheets have grooves or beads extending in said transporting direction.

16. The apparatus for an accurately positioned guidance of a flat textile structure according to claim 11, wherein said clamping plates have grooves or beads extending in said transporting direction.

17. The apparatus for an accurately positioned guidance of a flat textile structure according to claim 11, wherein said clamping strips have grooves or beads extending in said transporting direction.

* * * * *